US009536427B2

(12) United States Patent
Tonguz et al.

(10) Patent No.: US 9,536,427 B2
(45) Date of Patent: Jan. 3, 2017

(54) METHODS AND SOFTWARE FOR MANAGING VEHICLE PRIORITY IN A SELF-ORGANIZING TRAFFIC CONTROL SYSTEM

(71) Applicant: Carnegie Mellon University, Pittsburgh, PA (US)

(72) Inventors: Ozan Tonguz, Pittsburgh, PA (US); Wantanee Viriyasitavat, Pittsburgh, PA (US)

(73) Assignee: Carnegie Mellon University, Pittsburgh, PA (US)

( * ) Notice: Subject to any disclaimer, the term of this patent is extended or adjusted under 35 U.S.C. 154(b) by 49 days.

(21) Appl. No.: 14/214,885

(22) Filed: Mar. 15, 2014

(65) Prior Publication Data

US 2014/0278029 A1 Sep. 18, 2014

Related U.S. Application Data

(60) Provisional application No. 61/852,251, filed on Mar. 15, 2013.

(51) Int. Cl.
*G08G 1/09* (2006.01)
*G08G 1/087* (2006.01)

(52) U.S. Cl.
CPC ..... *G08G 1/087* (2013.01)

(58) Field of Classification Search
CPC .... G08G 1/164; G08G 1/096741; G08G 1/07; G08G 1/087; G08G 1/096716; G08G 1/096775; G08G 1/096811; G08G 1/096844; G08G 1/163; G01S 13/867; G01S 13/931; G01S 17/023; G01S 2013/9325; G01S 2013/9342; G01S 2013/9346; G01S 2013/935;G01S 2013/9353; G01S 2013/9357
See application file for complete search history.

(56) References Cited

U.S. PATENT DOCUMENTS 6,246,954 B1 6/2001 Berstis et al.
6,339,381 B1 1/2002 Takikita
(Continued)

FOREIGN PATENT DOCUMENTS

EP 0911788 A2 4/1999
EP 2101305 A2 9/2009
WO 2012009620 A1 1/2012

OTHER PUBLICATIONS

International Search Report and Written Opinion dated Nov. 7, 2011, for related PCT/US2011/044157 filed Jul. 15, 2011.
(Continued)

*Primary Examiner* — Truc M Do
(74) *Attorney, Agent, or Firm* — Downs Rachlin Martin PLLC

(57) ABSTRACT

Methods and software for managing vehicle priority proximate to a potential travel-priority conflict zone, such as a roadway intersection, where travel conflicts, such as crossing traffic, can arise. Coordination involves forming an ad-hoc network in a region containing the conflict zone using, for example, vehicle-to-vehicle communications and developing a dynamic traffic control plan based on information about vehicles approaching the conflict zone. Instructions based on the dynamic traffic control plan are communicated to devices aboard vehicles in the ad-hoc network, which display one or more virtual traffic signals to the operators of the vehicles and/or control the vehicles (for example, in autonomous vehicles) in accordance with the dynamic traffic control plan, which may account for a priority level associated with one or more of the vehicles.

6 Claims, 8 Drawing Sheets

(56) References Cited

U.S. PATENT DOCUMENTS

| | | | | |
|---|---|---|---|---|
| 7,295,925 | B2 | 11/2007 | Breed et al. | |
| 7,636,117 | B2 | 12/2009 | Schnaithmann | |
| 7,647,180 | B2 | 1/2010 | Breed | |
| 8,478,642 | B2 | 7/2013 | Dey et al. | |
| 8,615,354 | B2 | 12/2013 | Barker et al. | |
| 2003/0154017 | A1 | 8/2003 | Ellis | |
| 2004/0158390 | A1 | 8/2004 | Mukaiyama | |
| 2005/0195092 | A1* | 9/2005 | Takahashi | G01C 21/26 340/692 |
| 2005/0221759 | A1* | 10/2005 | Spadafora | G08G 1/09 455/41.2 |
| 2006/0095199 | A1 | 5/2006 | Lagassey | |
| 2006/0142933 | A1 | 6/2006 | Feng | |
| 2006/0291473 | A1 | 12/2006 | Chase et al. | |
| 2007/0008174 | A1* | 1/2007 | Schwartz | G08G 1/087 340/902 |
| 2007/0008927 | A1 | 1/2007 | Herz et al. | |
| 2007/0118280 | A1 | 5/2007 | Uhlmann et al. | |
| 2008/0095134 | A1 | 4/2008 | Chen et al. | |
| 2008/0234920 | A1 | 9/2008 | Nurminen | |
| 2008/0234925 | A1 | 9/2008 | Lo | |
| 2008/0252485 | A1 | 10/2008 | Lagassey | |
| 2009/0048750 | A1* | 2/2009 | Breed | G08G 1/161 701/70 |
| 2009/0063030 | A1 | 3/2009 | Howarter et al. | |
| 2009/0066492 | A1 | 3/2009 | Kubota | |
| 2009/0082949 | A1* | 3/2009 | Petrie | B60T 7/22 701/119 |
| 2009/0128363 | A1 | 5/2009 | Wagenhuber et al. | |
| 2009/0140887 | A1* | 6/2009 | Breed | G01C 21/165 340/990 |
| 2009/0174573 | A1* | 7/2009 | Smith | G08G 1/166 340/905 |
| 2009/0198412 | A1 | 8/2009 | Shiraki | |
| 2009/0198440 | A1 | 8/2009 | Shiraki et al. | |
| 2009/0271112 | A1* | 10/2009 | Basnayake | G08G 1/161 701/469 |
| 2010/0020169 | A1 | 1/2010 | Jang et al. | |
| 2010/0185382 | A1 | 7/2010 | Barker et al. | |
| 2010/0256836 | A1 | 10/2010 | Mudalige | |
| 2011/0035141 | A1 | 2/2011 | Barker et al. | |
| 2011/0144896 | A1 | 6/2011 | Howarter et al. | |
| 2011/0169661 | A1* | 7/2011 | Eichhorst | G08G 1/087 340/906 |
| 2012/0026014 | A1* | 2/2012 | Miller | G08G 1/07 340/929 |
| 2012/0249343 | A1* | 10/2012 | Thomas | G08G 1/096716 340/905 |
| 2013/0116915 | A1 | 5/2013 | Ferreira et al. | |

OTHER PUBLICATIONS

Ching-Ling Huang et al., "Adaptive Intervehicle Communication Control for Cooperative Safety Systems," IEEE Network, IEEE Service Center, New York, NY, XP011287978, ISSN: 0890-8044, vol. 24, No. 1, Jan. 1, 2010, pp. 6-13.

Jeffrey Miller Ed et al., "Vehicle-to-vehicle-to-infrastructure (V2V2I) intelligent transportation system architecture," Intelligent Vehicles Symposium, 2008 IEEE, XP031318946, ISBN: 978-1-4244-2568-6; Jun. 4, 2008, pp. 715-720.

Office Action (Non-Final Rejection) dated Mar. 21, 2014 related to U.S. Appl. No. 13/809,925, filed Jan. 14, 2013.

Notice of Allowance dated Oct. 22, 2014, issued in connection with related U.S. Appl. No. 13/809,925, filed Jan. 14, 2013.

Response to Office Action dated Aug. 21, 2014, issued in connection with related U.S. Appl. No. 13/809,925, filed Jan. 14, 2013.

Ching-Ling Huang et al: "Adaptive Intervehicle Communication Control for Cooperative Safety Systems", IEEE Network, IEEE Service Center, New York; vol. 24, No. 1, Jan. 1, 2010, pp. 5-13; ISSN: 0890-8044.

* cited by examiner

METHODS AND SOFTWARE FOR MANAGING VEHICLE PRIORITY IN A SELF-ORGANIZING TRAFFIC CONTROL SYSTEM

RELATED APPLICATION DATA

This application claims the benefit of priority of U.S. Provisional Patent Application Ser. No. 61/852,251, filed on Mar. 15, 2013, and titled "Methods, Apparatuses, and Systems for Priority Management of Vehicles in Self-organizing Traffic Control Systems," which is incorporated by reference herein in its entirety.

FIELD OF THE INVENTION

The present invention generally relates to the field of vehicular traffic control. In particular, the present invention is directed to methods and software for managing vehicle priority in a self-organizing traffic control system.

BACKGROUND

The use of traffic lights (also known as stoplights, traffic lamps, traffic signals, and other related terms) to control traffic flow at intersections is a long-standing means to promote traffic safety and efficiency. While traffic lights and intersection-based signs are the predominant means of controlling traffic flow, other methods of intersection-based traffic management have been the subject of some experimentation.

SUMMARY OF THE DISCLOSURE

In one implementation, the present disclosure is directed to a method of managing vehicle priority proximate to a potential travel-priority conflict zone. The method is executed in a dynamic traffic control system and comprises: communicating with a first component of the dynamic traffic control system located on-board a vehicle proximate to the potential travel-priority conflict zone so as to establish a dynamic traffic control plan for avoiding a travel-priority conflict in the potential travel-priority conflict zone; coordinating with the first component of the dynamic traffic control system via said communicating to elect a dynamic traffic controller as a temporary coordinator vehicle responsible for temporarily coordinating the dynamic traffic control plan; receiving a priority-request message from a priority vehicle; and transmitting a priority-granted message to the priority vehicle.

In another implementation, the present disclosure is directed to a method of managing vehicle priority proximate to a potential travel-priority conflict zone. The method is executed in a dynamic traffic control system and comprises: communicating with a first component of the dynamic traffic control system located on-board a vehicle proximate to the potential travel-priority conflict zone so as to establish a dynamic traffic control plan for avoiding a travel-priority conflict in the potential travel-priority conflict zone; coordinating with the first component of the dynamic traffic control system via said communicating to elect a dynamic traffic controller as a temporary coordinator vehicle responsible for temporarily coordinating the dynamic traffic control plan; receiving a priority-request message from a priority vehicle; retrieving a priority level from the priority-request message; and modifying the dynamic traffic control plan as a function of the priority level.

In a further implementation, the present disclosure is directed to a machine-readable storage medium containing machine-executable instructions for performing a method of managing vehicle priority proximate to a potential travel-priority conflict zone, wherein the method is executed in a dynamic traffic control system. The machine-executable instructions comprise: a first set of machine-executable instructions for communicating with a first component of the dynamic traffic control system located on-board a vehicle proximate to the potential travel-priority conflict zone so as to establish a dynamic traffic control plan for avoiding a travel-priority conflict in the potential travel-priority conflict zone; a second set of machine-executable instructions for coordinating with the first component of the dynamic traffic control system via said communicating to elect a dynamic traffic controller as a temporary coordinator vehicle responsible for temporarily coordinating the dynamic traffic control plan; a third set of machine-executable instructions for receiving a priority-request message from a priority vehicle; and a fourth set of machine-executable instructions for transmitting a priority-granted message to the priority vehicle.

In yet another aspect, the present disclosure is directed to a machine-readable storage medium containing machine-executable instructions for performing a method of managing vehicle priority proximate to a potential travel-priority conflict zone, wherein the method is executed in a dynamic traffic control system. The machine-executable instructions comprise: a first set of machine-executable instructions for communicating with a first component of the dynamic traffic control system located on-board a vehicle proximate to the potential travel-priority conflict zone so as to establish a dynamic traffic control plan for avoiding a travel-priority conflict in the potential travel-priority conflict zone; a second set of machine-executable instructions for coordinating with the first component of the dynamic traffic control system via said communicating to elect a dynamic traffic controller as a temporary coordinator vehicle responsible for temporarily coordinating the dynamic traffic control plan; a third set of machine-executable instructions for receiving a priority-request message from a priority vehicle; a fourth set of machine-executable instructions for retrieving a priority level from the priority-request message; and a fifth set of machine-executable instructions for modifying the dynamic traffic control plan as a function of the priority level.

Other aspects and features of these embodiments as well as other embodiments of the present disclosure will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

This disclosure addresses, in part, systems, methods, and software for managing vehicle priority in a self-organizing traffic control system using an ad-hoc vehicle-based network facilitated by vehicle-to-vehicle ("V2V") communication. In this context, V2V communication enables development of a dynamic traffic control plan ("DTCP") that can resolve a travel-priority conflict in the potential-conflict zone which, if left unresolved, could result in a collision. Generally, a DTCP includes a set of travel instructions that are communicated to vehicles participating in the ad-hoc network for the particular potential-conflict zone. For example, these instructions can include a sequence by which vehicles approaching from different directions may proceed through a potential-conflict zone, the speed at which vehicles approaching a conflict zone should be traveling, and so forth. One important aspect of a DTCP is that the instructions are tailored for the specific vehicles participating in a conflict and are also coordinated with the other vehicles participating in the conflict so as to resolve the conflict without incident. Additionally, this coordination can assist with optimizing vehicle flow through a potential-travel-priority conflict zone as a function of traffic volume, road conditions, known or predicted travel routes for vehicles near the conflict zone, and/or a priority status of one or more of such vehicles. The systems and methods described herein do not necessarily require intersection-based or road-based infrastructure to resolve such priority conflicts, but they certainly may. For example, systems and methods disclosed herein can be based on a pure V2V network and/or a network that involves communications from onboard units (OBUs) to roadside units (RSUs) and then to OBUs. In addition, in yet other embodiments, for example embodiments designed and configured to resolve vehicle-pedestrian priority conflicts, the methods and systems of the present disclosure may benefit from other intersection-based infrastructure.

Several examples of systems and methods for coordinating vehicular traffic flow using a DTCP developed in an ad-hoc vehicle-based network are described below. However, as those skilled in the art will appreciate from reading this entire disclosure, the exemplary systems, methods, and software described are but a small selection of the systems, methods, and software that can be used to accomplish the teachings disclosed herein.

Figure 1:
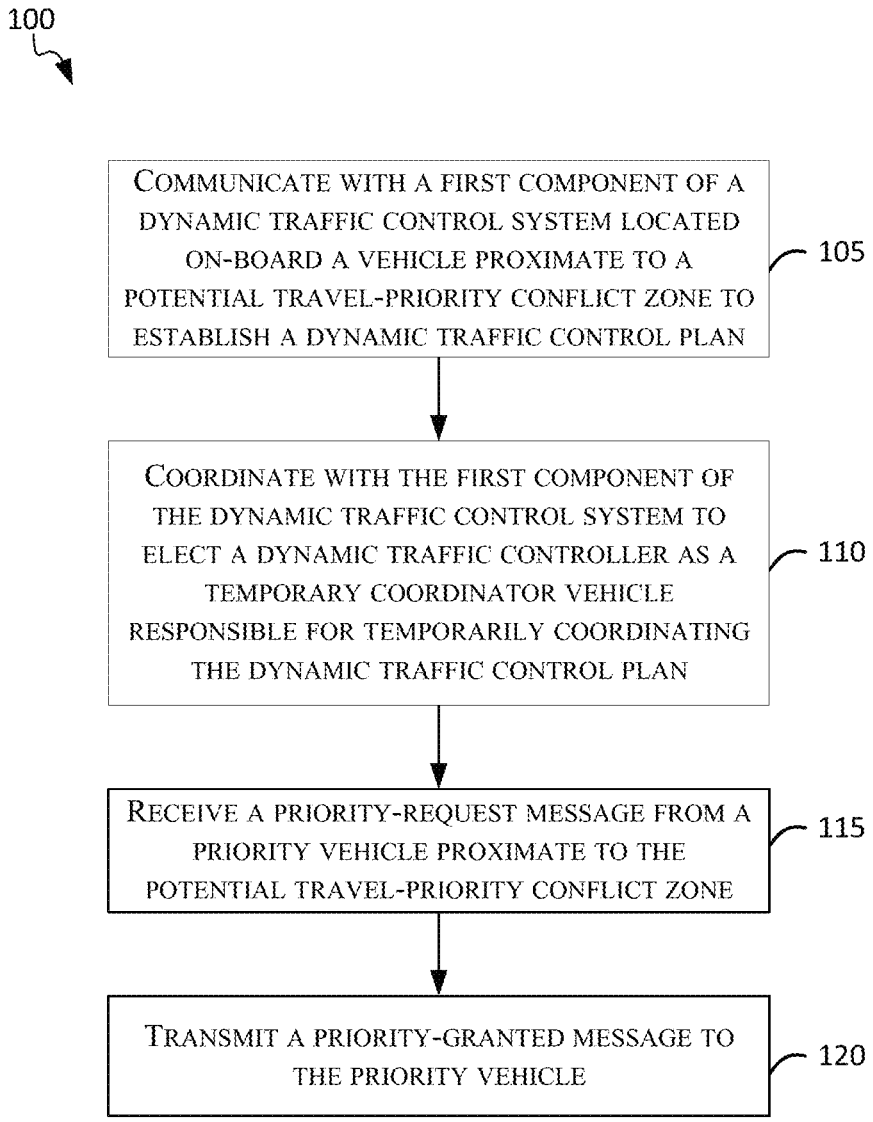
FIG. 1 is a flow diagram illustrating an exemplary method of managing vehicle priority in a self-organizing traffic control system.

Turning now to the drawings, FIG. 1 illustrates an exemplary method 100 of resolving a potential vehicular travel-priority conflict by communicating with approaching vehicles so as to collect data relevant to an incipient conflict, creating a DTCP to avoid or resolve the conflict, communicating the DTCP to the vehicles participating in the potential conflict, receiving a priority-request message from a priority vehicle proximate to the potential conflict, and transmitting a priority-granted message to the priority vehicle. Method 100 may be implemented in a dynamic traffic control ("DTC") system using a computing system, such as computing system 800 of FIG. 8 or a network of such or similar computing systems (e.g., a wide-area network, a global network (such as the Internet), and/or a local area network (LAN), such as a network based on dedicated short-range communications ("DSRC") technology, among others), that is generally: 1) programmed with instructions for performing steps of a method of the present disclosure; 2) capable of transmitting, receiving, and/or storing data necessary to execute such steps; and 3) capable of providing any user interface that may be needed for a user to interact with the system, including setting the system up for a vehicle priority managing session, among other things. Those skilled in the art will readily appreciate that aspects of the present disclosure can be implemented with and/or within any one or more of numerous devices, ranging from self-contained devices, such as dedicated DTC devices that are either mobile or permanently mounted to vehicles, mobile phones, smartphones, tablet computers, laptop computers, to networks each having two or more of any of these devices, among others. Fundamentally, there is no limitation on the physical construct of a DTC system, as long as it can provide one or more of the features and functionality described herein. In some embodiments, depending on specific implementation, one or more steps of method 100 and/or any other method(s) incorporating features/functionality disclosed herein may be implemented substantially in real-time.

A DTC system used to implement method 100, may include, for example, a V2V communications system, a processor, DTC software, a physical memory, a user interface, and an optional vehicle interface. These elements can be used together, in whole or in part, to create a DTCP, communicate a DTCP to other vehicles, receive a DTCP from another vehicle, and execute the instructions supplied by the DTCP, depending on the configuration of the DTC system and the needs of the particular DTCP ad-hoc vehicle-based network under consideration. The DTC system can also optionally include an on-board location database and/or a travel-route database. Examples of DTC systems that can be adapted for use with the subject matter of the present disclosure are disclosed in U.S. Patent Application Publication No. 2013/0116915, published on May 9, 2013, and titled "METHODS AND SYSTEM FOR COORDINATING VEHICULAR TRAFFIC USING IN-VEHICLE VIRTUAL TRAFFIC CONTROL SIGNALS ENABLED BY VEHICLE-TO-VEHICLE COMMUNICATIONS" ("the '915 publication"), which is incorporated herein by reference for its disclosure of such systems, including hardware, as well as software and corresponding methods that are compatible with aspects, features, and functionalities of the present disclosure, as will be recognized by those skilled in the art. In addition, the '915 publication is incorporated herein by reference for its disclosure of visual representations of exemplary intersection in FIGS. 6A to 6D and FIG.

7 thereof, and corresponding respective descriptions that may aid the reader of the present application in visualizing examples involving elevated-priority vehicles, such as emergency vehicles and/or mass-transit modalities, such as buses, trains, trolleys, streetcars, etc.

In one embodiment, a V2V communications system may be designed and configured to receive signals from at least one other vehicle within the ad-hoc vehicle-based network at issue that have the same or a similar V2V communications system. These signals can include information characterizing the type of vehicle, its weight, its speed, relevant traffic and road conditions, the manner of approach of a vehicle, and a priority status for the vehicle, among many others. A V2V communications system may also be designed and configured to provide a communications link between vehicles approaching a potential travel-priority conflict zone in order to elect a traffic coordinator (or leader), collect data, and perform analyses so as to create a DTCP, as well as to communicate the DTCP to the participating vehicles.

A V2V communications system may be designed and configured to transmit and receive signals communicating DTCP instructions using any one or more of a variety of protocols. For example, a V2V communications system may broadcast signals transmitting DTCP instructions periodically from a vehicle through a process known in the art as "beaconing." As part of the beaconing process, the information described above is communicated at regular intervals and throughout a given geographic area surrounding the vehicle performing the beaconing. Beaconing signals may include, for example, velocity, heading, vehicle type, acceleration (using an in-vehicle accelerometer), vehicle priority status, a network address or other network identifier for the originator, a unique beacon-signal identifier, a timestamp, a lane identifier, and/or an indication of whether the originator is currently a traffic coordinator, among others. In one specific example, beaconing can utilize a beacon packet with the following composition: ||Packet Type|Unique Packet ID|Timestamp|Unique Vehicle Address|Coordinates|Direction|Lane ID|VTL Leader||. These beaconing signals (e.g., packets) can be received and/or retransmitted by another DTC system similar to the originating system through a V2V system. Furthermore, beaconing signals can be used in cooperation with an onboard location database. The use of a location database with periodically repeated beaconing signals can permit a DTC system to track the location of proximate vehicles. Even further, when a location database and beaconing signals are used along with a travel-route database, a DTC system can anticipate travel-priority conflict zones because the system is informed of, at the minimum, the location and velocity of proximate vehicles in the context of known travel-routes. In some examples, this can permit a DTC system to adapt to local vehicle densities and to anticipate, and accommodate, density trends.

A V2V communications system may also or alternatively be designed and configured to transmit and receive signals using non-beaconing protocols as well, such as signals transmitted to or from another proximate vehicle directly, for example using a handshake, push, or pull protocol, among others. Or, in yet another example, the above-described signals can be communicated between vehicles using a method known in the art as "Geocasting." In this method, vehicles can communicate with other vehicles regionally proximate but out of DSRC range by using intervening vehicles as transponders that propagate the DSRC signal. Those skilled in the art will appreciate that beaconing, Geocasting, and direct transmission are but a selection of the many existing techniques that can be used in connection with the teachings of the present disclosure.

A DTC system may further include a processor designed and configured to receive one or more signal(s) from a V2V system and initiate an analysis of the information contained in the signal(s) as a precursor to developing a DTCP. Such a processor, which can include multiple processors operating together, may be linked by connections that enable operative communication between the V2V communications system, physical memory, any user interface, and any vehicle interface. These communication means can include physical connections, such as metal conductors, Ethernet cable, optical fiber, and others well known in the art. Additionally, non-physical connections, such as wireless communication over radio frequencies (e.g., BLUETOOTH® radio, WiFi, etc.), mobile communication device frequencies, or optical connections using visible or non-visible light may be used. Those skilled in the art will appreciate that many other communications methods are also possible without departing from the teachings of the present disclosure. Furthermore, although it can be, such a processor need not be exclusively dedicated to a DTC system. Indeed, devices that can be used as a processor are ubiquitous throughout modern society. These devices include pre-existing processors in vehicles (often referred to as electronic control units, engine control units, or "ECUs"), mobile phones, and many other devices that can be programmed to be used in conjunction with a vehicle or by an operator of a vehicle.

Such a processor as may be included in a DTC system may employ DTC software to analyze inputs relevant to one or more anticipated particular potential-travel-priority-conflict zones. This DTC software, which may be stored in physical memory in operative communication with the processor, can execute any of a wide variety of analytical operations upon inputs in furtherance of developing a DTCP, as described herein. Furthermore, DTC software can include an on-board location database, a travel-route database, and/or lane-level data, either or both of which can include information relevant to the creation of a DTCP by a DTC system, and which can be updated periodically. For example, when a vehicle is approaching a potential travel-priority conflict zone but does not detect any DTCP messages originating from other vehicles, a DTC system associated with that vehicle may utilize such an on-board location database, a travel-route database, and/or lane-level data to infer and/or predict conflicts that may give rise to the collaborative creation of a DTCP.

It should be understood that while an on-board location database and travel-route database are mentioned above specifically, other databases can be used to contribute to the analysis of the anticipated travel-priority conflict depending on the specific application of a DTC system. Exemplary applications of a DTC system include creating DTCPs to avoid pedestrian-pedestrian conflicts, and pedestrian-motorized vehicle conflicts, in zones that can have unrestricted access (e.g., a public road intersection) or in zones that have restricted access (e.g., pedestrian zone, bike path, parking lot, etc.). For example, these databases can include a building floor plan, a manufacturing-facility or warehouse layout, a map of a city that also includes pedestrian walkways and bike paths (defining vehicle-free zones), and air-routes specified by altitude and geospatial coordinates. Those skilled in the art will appreciate that many other examples of databases can be used in connection with DTC software to enhance the development of a DTCP for a variety of applications.

A user interface in operative communication with a processor of a DTC system can be designed and configured, for example, to communicate traffic control instructions to an operator of a vehicle needed to comply with a DTCP, thereby obviating an anticipated travel-priority conflict. In some examples, such a user interface may include a display capable of displaying red, amber, and green lights in response to an appropriate DTC signal, thereby providing traffic control instructions to the operator of a vehicle that are analogous to instructions provided by a conventional infrastructure-based traffic light and therefore familiar to vehicle operators. Such instructions can also be provided by a user interface of a mobile communications device or a GPS unit and can be symbolic (e.g., the in-vehicle traffic light), spoken (e.g., through the speaker unit of a mobile communications device, a GPS unit, or an in-vehicle sound system), graphically displayed (e.g., a dedicated in-vehicle display, a generic in-vehicle display, a heads-up display or projection, or a mobile communications device), or otherwise communicated. Those skilled in the art will appreciate the many types of devices that can function as a user interface, in addition to those mentioned above. Such a user interface can also be used by a DTC system to solicit input from an operator (or occupant) of the vehicle, such as preferences and settings for the system or to provide additional information in order to inform a processor in the DTC system of information relevant to the DTCP.

Furthermore, as those skilled in the art will appreciate, a DTC system can also be used to implement other methods, in addition to method 100, consistent with the teaching of the present disclosure. For example, while a DTC system may receive signals from other vehicles, a DTC system can function equally well in the transmission of signals to other vehicles. In one example, upon receiving data from other vehicles used to create a DTCP, a DTC system can transmit the DTCP to other vehicles using DTC systems or components thereof.

As noted above, DTC system may optionally include a vehicle interface that can interact directly with the operative functionality of the vehicle, such as in a semi-autonomous or fully autonomous vehicle or in autonomous driving methods, thereby automatically implementing the DTCP little to no input from the vehicle operator, if any. For example, upon receipt or creation of a DTCP, a vehicle interface may, through operative connections to the various vehicle systems (e.g., propulsion, steering, braking, directional signal, etc.) direct the vehicle to conform to the DTCP. For example, if the DTCP requires the vehicle to stop at a given coordinate for at least 30 seconds or until otherwise approved to proceed, a vehicle interface can interact with propulsion and braking systems of the vehicle in order to conform to the instructions. While the teachings of the present disclosure can be used in concert with this and other related technologies to automatically conform the vehicle's conduct to the DTCP, those skilled in the art will appreciate that other methods of placing a vehicle interface in communication with relevant vehicular systems are available.

A vehicle interface can also provide vehicle data and information in order to better inform a DTC system in the creation of the DTCP. For example, a vehicle interface can provide velocity, heading, vehicle type, acceleration (using an in-vehicle accelerometer), vehicle priority status, and other information relevant to the creation of the DTCP to a processor in the DTC system. This information can then be used by the processor in cooperation with DTC software to create a DTCP. Of course, this information may also be communicated via a V2V communications system to another vehicle, such as one that has been elected as a traffic coordinator and charged with creating the DTCP.

Having described a DTC system that may be used to implement one or more portions of method 100 and turning again to FIG. 1, method 100 can begin, for example, when at least two vehicles approach a potential vehicular travel-priority conflict zone. The types of vehicles contemplated in this example, and indeed in the entirety of the present disclosure, can be any propelled, or mobile, vehicle including, for example, a self-propelled, but human-controlled, vehicle having a motor or an engine such as an automobile, a bus, a taxi, a truck, a motorcycle, an aircraft, a railed vehicle (e.g., train, trolley, streetcar, etc.), a SEGWAY® personal transporter, an electric cart, a motorized wheelchair, a fork lift or other industrial equipment, and other similar devices. In other examples, the vehicle can be any self-propelled and self-controlled vehicle, such as an industrial robot, automated equipment, and other types of automated vehicles. In yet further examples, the vehicle can include a human powered vehicle such as a bicycle, a tricycle, a skate-board, and other similar vehicles. Furthermore, method 100 is equally applicable to a potential vehicular travel-priority conflict involving two vehicles of different types and/or priority statuses. As will be further explained below, the teachings of the present disclosure may even be applied to a pedestrian carrying a mobile phone or other mobile device that includes features and functionalities of the present invention, which, for convenience, is included in the term "vehicle." Fundamentally, there is no limit to the types of vehicles contemplated by the present disclosure or the types of vehicles that can participate in the conflict-resolving systems and methods described herein.

In addition to the wide variety of vehicles that can approach a potential-travel-priority-conflict zone, the nature of such a zone can be similarly broadly defined. Generally, a "potential-travel-priority-conflict zone" is a zone where two or more movable objects, for example, vehicles, people, etc., and any combination thereof, have the potential of being in conflict with one another in terms of travel priority. Such a conflict typically, but not necessarily, results in a collision or near-collision between movable objects involved. The word "potential" connotes that while an actual conflict can happen, they do not necessarily happen. In other words, while a particular zone has the potential for conflicts, actual conflicts may not happen for a variety of reasons, such as very low traffic volumes and attentive vehicle operators, among others.

In some examples, the potential-travel-priority-conflict zone can include road intersections, such as a traditional road intersection, controlled-access roadway entrance- and exit-ramps, merging traffic lanes, and rail crossings and junctures, among others. For reasons that will be explained below, because the methods and systems include utilization of ad-hoc, vehicle-based networks, the potential-conflict zone need not be at a fixed location known prior to the occurrence of a travel-priority conflict, as is presumed with the placement of a traditional traffic light. Instead, the potential-conflict zone can be at any point on a travel route. For example, such travel routes can include, but are not limited to, a one-way street, a two-lane road with anti-parallel lanes, or even a parking lot. Also, in other examples, a potential-conflict zone can occur between a pedestrian and an automobile at an intersection, or at any point not at an intersection. In yet further examples, the potential-conflict zone can occur between aircraft in the air, on a taxi-way, or in some other area. In even further examples, the conflict zone can occur in areas not publicly accessible but still accessible by vehicular traffic, such as pedestrian zones, and warehouses that include both mobile industrial equipment and pedestrian traffic. Fundamentally, there is no limit to the locations at which a potential-conflict zone can be defined because the systems, methods, and software disclosed herein resolve conflicts as they arise, wherever they occur.

When two or more vehicles meet at a conflict zone, method 100 may begin at step 105, at which DTC systems of the vehicles communicate with each other in order to establish a DTCP that utilizes an ad-hoc communication network usable to resolve travel-priority conflicts. In one example, the vehicles communicate with each other using DSRC that can use IEEE 802.11(p) communication protocol via DSRC-capable radios in order to receive and transmit relevant information. These DSRC radios can be included in virtually any type of device, whether included in a vehicle as manufactured, added to a vehicle or vehicle-based DTC system using an after-market addition, or included in a mobile communication device (e.g., a cell phone or a smart phone) that is used in conjunction with a vehicle or vehicle-based DTC system. Those skilled in the art, being already familiar with DSRC technology, will appreciate that there is no limit to the manner in which a DSRC radio can be implemented in conjunction with a vehicle in order to enable the teachings of the present disclosure.

Furthermore, as those skilled in the art will appreciate, the DSRC protocol is not the only means by which vehicles can communicate. Other examples of methods by which vehicles can communicate include other radio-frequency communication protocols, cellular communications (including First Generation, Second Generation (2G), Third Generation (3G), Fourth Generation (4G), etc.), Wi-Fi, Wi-Fi enabled internet, WiMAX, laser or other light-based communication or data transfer, and others, as well as combinations thereof.

In the context of step 105, a variety of inputs can be used to identify anticipated priority conflicts and establish the DTCP that is subsequently communicated to the other vehicles approaching the travel-priority conflict zone. For example, one type of input includes vehicle-specific metrics. Such metrics may include, but are not limited to, velocity of travel, distance from the conflict zone, vehicle weight, indicia of traffic congestion, vehicle type, vehicle priority, and direction of travel. Other types of inputs can include known travel-route features stored in a travel-route database and/or predicted travel-route features derived therefrom. Examples of these types of inputs can include, but are not limited to, lane-width, road-width, changes in lane- or road-direction or elevation, obstructions to vehicle travel or visibility, construction projects affecting vehicle flow, and many other similar characteristics that can be appreciated by those skilled in the art.

Yet further examples of inputs that can be used to identify anticipated priority conflicts include indirectly acquired factors that can be based on calculations using the above mentioned direct inputs. One example illustrating this concept is the calculation of the stopping distance of a vehicle based on the direct inputs of vehicle velocity, weight, and travel-route surface conditions, for example, surface type (gravel, concrete, asphalt, etc.) and surface quality (e.g., dry, wet, snow-covered, ice-covered, etc.). These indirectly acquired factors can then be compared to a directly acquired vehicle position to determine if the vehicle can stop safely before entering the conflict zone.

Other indirectly acquired factors can also include parametric factors that are based on directly acquired inputs and indirectly acquired factors, which are then analyzed using statistical and mathematical methods well known to those skilled in the art. For example, continuing with the immediately preceding example of stopping distance, a processor in communication with a DTC system can determine whether a vehicle can stop safely before entering a conflict zone based on direct inputs of vehicle velocity and weight that are then used in connection with a statistical analysis algorithm that determines the probability of the vehicle stopping safely. Using this type of parametric analysis can further enhance the sophistication, precision, and accuracy of this aspect of the system. Furthermore, priority conflicts can be anticipated using beaconing in connection with a location database.

The foregoing examples are, of course, not necessary in the event that a vehicle approaches a conflict zone for which there is already an active DTCP. In this case, the approaching vehicle need only receive the existing DTCP through any of the communication methods described above and execute the instructions therein, if any. In some circumstances, a vehicle can receive an active DTCP and facilitate its transmission to the other vehicles. This receiving/sending vehicle, which can function as a "traffic coordinator," is described below in the context of creating a new DTCP. It will be appreciated that while in many situations the DTCP can be created upon approaching a potential travel-priority-conflict zone, as described immediately above, in some cases an existing DTCP is merely transferred to a new vehicle to maintain execution of an existing DTCP.

At step 110 of method 100, vehicles approaching a potential travel-priority-conflict zone communicate with each other, using one or more of the methods and systems described above, to elect a vehicle that can provide a coordinated set of DTCP instructions to vehicles participating in the ad-hoc vehicle-based network established to avoid any real conflicts that could occur in the potential travel-priority conflict. As noted above, this elected vehicle, for the purposes of the present disclosure, is known as a traffic coordinator.

The traffic coordinator can be elected from among candidates in the ad-hoc vehicle-based network based on any one or more of a number of different factors, including those factors that indicate the ability to stop safely before a conflict zone, the ability to influence the traffic flow through the conflict zone, the traffic density on the various approaches to the travel-priority conflict zone, past waiting times, and others. For example, a subset of candidates for coordinators may be identified as those leading their respective queue of vehicles on a given approach to a priority-conflict zone. In this example, these vehicles will be the first to arrive at the conflict zone, and are therefore more likely to be in communicative contact with vehicles approaching the conflict zone from other directions. This arrangement facilitates, but is not required for, V2V communication. Furthermore, those vehicles leading their respective queues can prevent the vehicles trailing them from proceeding further, thereby controlling the vehicular traffic flow if so required by the DTCP. Other factors that can be used to elect the coordinator include, for example, the ability to stop safely before entering the potential travel-priority-conflict zone, the presence of possible barriers to V2V communication, a priority status of one or more vehicles approaching the potential conflict zone, referred to herein as a "priority vehicle" (e.g., emergency-service vehicles, mass-transit vehicles, vehicles involved in a funeral procession, etc.), traffic planning policies favoring higher traffic flow in a given direction, and road features (e.g., blind spots, road curvature, local road topography, vehicle density generally and on specific approaches to the conflict zone, etc.). Those skilled in the art will appreciate that other factors can also be used to elect a traffic coordinator.

Once elected at step 110, the traffic coordinator can broadcast its election as the traffic coordinator, thereby informing proximate vehicles of its identity and location. Such proximate vehicles may respond to the traffic coordinator with an acknowledgement signal such that the traffic coordinator can determine the extent of its authority by determining which of the proximate vehicles are equipped with compatible DTC systems. Also, once elected, the coordinator can establish a DTCP, as described above, and communicate it to the other vehicles approaching the potential-travel-priority-conflict zone. Optionally, the coordinator can periodically re-broadcast its identity as traffic coordinator and re-broadcast the DTCP to confirm control of the potential-conflict zone and inform any newly arrived vehicles.

While the examples of the present disclosure are primarily directed to localized travel-priority-conflict zones, various teachings found herein can also be applied to ad-hoc vehicle-based networks over a larger geographic area in order to facilitate travel efficiencies on a larger scale. In one embodiment, using techniques described above to facilitate longer-range communication (e.g., Geocasting), traffic coordinators at remote potential-conflict zones can communicate. This communication can facilitate regional traffic-flow efficiency by, for example, providing DTCP instructions to clear travel zones of vehicles in preparation for an approaching priority vehicle or, in another example, to coordinate the traffic flow through multiple conflict zones to increase the "green-light split" (i.e., the percentage of time vehicles on a given approach are permitted to proceed through the zone) along a desired travel-route, thereby reacting to variations in traffic density. Furthermore, in yet another embodiment, the ad-hoc system can be informed of local traffic planning policies through a program that can affect traffic flow, thereby taking advantage of larger-scale traffic management.

After step 110 of method 100, the traffic coordinator having been elected and the DTCP having been created and communicated to vehicles approaching a potential-travel-priority-conflict zone in the above-described steps, the vehicles can then participate in the DTCP. In one example, DTCP instructions are communicated to the vehicles participating in the ad-hoc vehicle-based network corresponding to the potential-travel-priority-conflict zone by providing each vehicle with a virtual traffic control, such as an in-vehicle traffic light. As used herein, the term "virtual" when used in the context of a traffic control, traffic control signal, or other traffic control means, refers to any such means that is effectively a replacement for one or more traditional infrastructure-based traffic control means, such as traffic lights, traffic signals, traffic signs, etc., as well as a human or automated traffic director that are often located at potential travel-priority-conflict zones.

In one example, depending on the instruction(s) sent to the vehicle(s) by the coordinator, a red, amber, or green light is presented to the operator of a vehicle participating in the conflict. Additionally, other types of virtual traffic control can be used to communicate the DTCP instructions to vehicles participating in an ad-hoc vehicle-based network for a particular potential-travel-priority-conflict zone. For example, the instructions can be provided aurally to the vehicle operator through a vehicle radio, a global-positioning system (GPS) device, a portable communications device (e.g., a mobile phone), or other similarly enabled system. In other examples, in which the DTCP instructions are provided directly to a vehicular control system, such as in the case of a semi-autonomous or fully autonomous vehicle, the vehicle itself will be able to respond directly to the instructions from the traffic coordinator. Those skilled in the art will appreciate that there are many techniques for executing the DTCP plan such that the vehicles and/or their operators participate in the plan.

In some embodiments, DTC systems can include mechanisms that allow certain vehicles to have higher priority than other vehicles in having the right of way at intersections. This embodiment would, for example, facilitate and expedite the motion of priority vehicles through traffic in urban areas in the case of an emergency and/or in another type priority situation. The traffic control scheme in this embodiment can be extended to address the priority management of other transportation systems as well, such as mass-transit systems, including transit-bus systems, light-rail systems, etc. By detecting the presence of a priority vehicle, a DTC system can assign priority (i.e., give right of way) to the road and/or travel lane on which the priority vehicle is traveling. To enable such a priority scheme, one or more of two mechanisms may be utilized: detection of a priority vehicle when it approaches and leaves an intersection and a priority assignment scheme. In some embodiments, prioritization may involve three or more levels of priority. For example, in one scheme, three priority levels are provided: a highest priority for emergency vehicles en route to an emergency, an intermediate priority for mass-transit vehicles carrying multiple passengers, and lowest priority for private passenger cars. In this example, the DTC system clears the route for the highest priority vehicles as quickly and efficiently as possible, overriding any normal DTCP to create a high-priority DTCP. For intermediate-priority vehicles, the DTC system may weight the travel directions and/or lanes containing mass-transit vehicles in a manner that allows each of those travel directions and/or lanes to clear more quickly than they would if a non-priority vehicle were present in place of each mass-transit vehicle.

In order to allow for detection of a priority vehicle, upon approaching a travel-priority conflict zone, a priority vehicle may periodically broadcast a priority-request message to announce its presence and demand for priority until it receives a priority-granted message from an elected traffic coordinator. In a scenario having three or more priority levels, each priority-request message may include a priority level indicator, which may be represented by a field of bits within a digital communications packet. For example, for the three-level priority scheme noted above, two bits may be provided to represent the priority level, with the sequence "00" identifying a non-priority vehicle, the sequence "01" identifying an intermediate-priority vehicle, and the sequence "11" identifying a highest-priority vehicle. In such an embodiment, the response by the elected coordinator, including the DTCP executed, would be a function of the priority level of the vehicle at issue.

Reflecting this, at step 115 of method 100, a DTC system, such as a DTC system of an elected traffic coordinator, may receive a priority-request message from the priority vehicle, and, at step 120, the DTC system may transmit a priority-granted message to the priority vehicle. Priority-request messages and priority-granted messages may contain substantially the same or similar information to a beaconing signal, though they may additionally or alternatively contain an indication of the priority level of the priority vehicle (e.g., emergency priority status, public transit priority status, funeral procession priority status, etc.), travel-route information for the priority vehicle, network identifiers for any current and/or past priority vehicles that have been granted priority and/or traffic coordinators that have granted priority, and/or one or more potential-conflict zone identifiers. Notably, in some embodiments, a traffic coordinator may additionally or alternatively detect the presence of the priority vehicle by analyzing beaconing signals originating from the priority vehicle, which may in some embodiments contain any of the information that may otherwise be contained in priority-request messages.

After receiving a priority-granted message transmitted at step 120 of method 100 the priority vehicle may be required to inform one or more other vehicles, such as a current traffic coordinator, of its departure from a given potential-conflict zone via a priority-clear message so that any vehicles proximate to the zone can resume standard DTCP operation. Priority-clear messages may contain substantially the same or similar information to a beaconing signal, though either may additionally include a potential-conflict zone identifier. In order to provide a priority-clear message, when a priority vehicle exits or is within a certain time or distance of exiting a potential-conflict zone, it may periodically broadcast a priority-clear message for a period of time, which a DTC system on the priority vehicle may determine as a function of the priority vehicle's location and/or velocity, the nature of the potential-conflict zone, and/or other similar parameters. If priority-clear messages do not reach the intended recipient(s), such as an elected traffic coordinator, the DTC system of the traffic coordinator can deduce the departure of the priority vehicle by detecting an absence of beaconing signals originating from the priority vehicle for a certain period of time (i.e., a time-out period).

Regarding the priority assignment scheme, once the presence of a priority vehicle is detected, the DTCP for the potential-conflict zone may need to be re-computed and broadcasted to one or more vehicles proximal the potential-conflict zone. While there are a number of algorithms that could be used for priority assignment, such as complex algorithms that analyze and account for route information associated with a priority vehicle and/or assign weights to priority vehicles as a function of a level of emergency and/or a number of passengers, among other parameters, even a simple scheme (i.e., always granting priority to a priority vehicle when possible) can be quite effective.

Given the same amount of traffic, a priority vehicle utilizing a DTC system and interacting with other vehicles capable of managing vehicle priority proximate to a potential travel-priority conflict zone encounters less severe traffic congestion as compared to the congestion found in typical scenarios using existing infrastructure such as conventional traffic lights. Because of a more efficient use of intersections as a resource and the fact that DTC systems can render traffic control ubiquitous (i.e., traffic control at every intersection), during rush-hours, traffic congestion may take place at a much later stage, as more vehicles must be present on a given route before traffic congestion takes place as compared to the typical scenarios with physical traffic lights and an identical traffic generation rate. As a result, vehicles, especially priority vehicles, reach their destination locations within a much shorter time duration when DTC systems capable of managing vehicle priority proximate to a potential travel-priority conflict zone are employed. Furthermore, when traffic congestion is inevitable (i.e., generated traffic exceeds the capacity of the road network), DTC systems can resolve the congestion more quickly; hence, travel time of both non-priority vehicles and priority vehicles can be substantially reduced.

Figure 2:
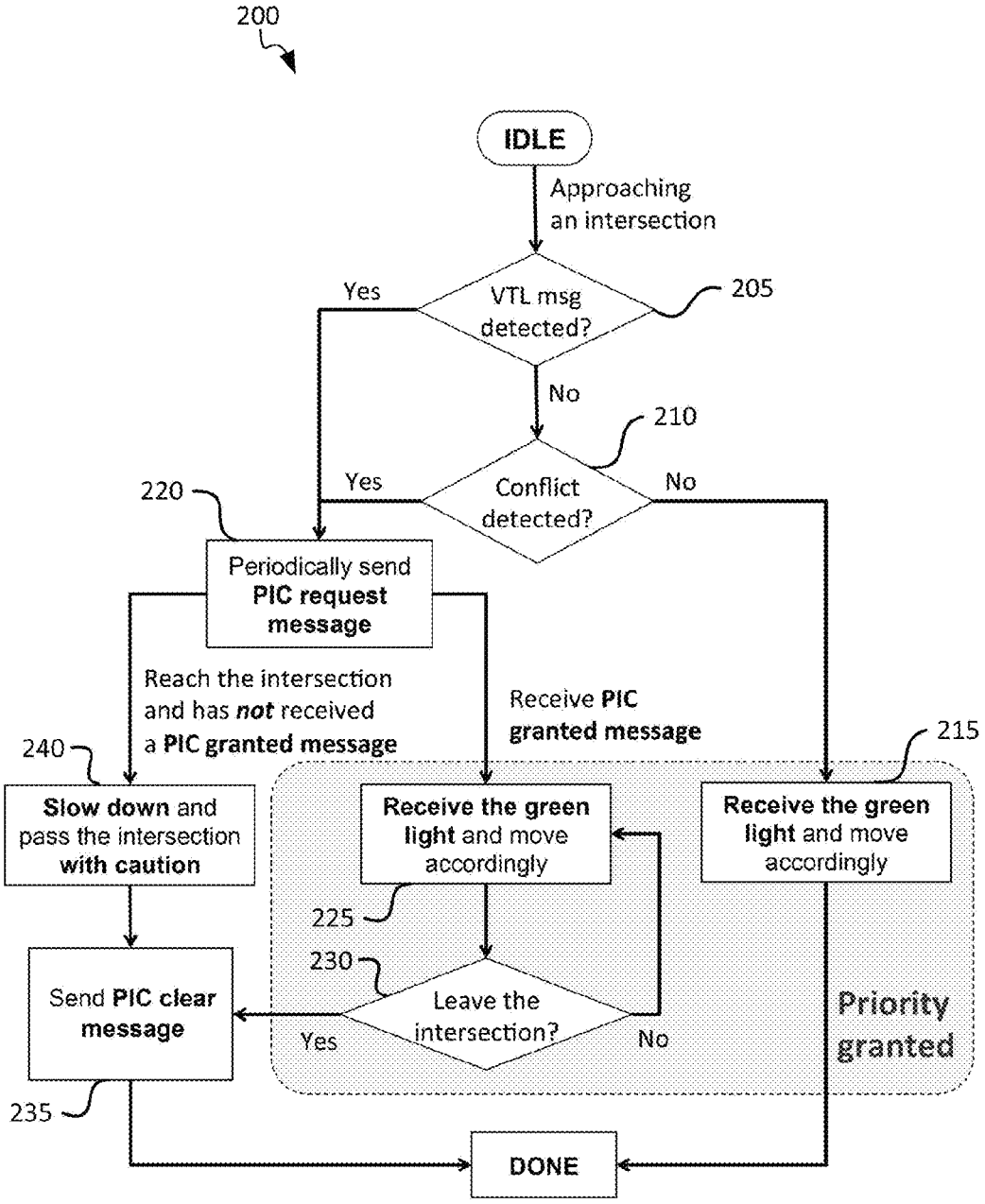
FIG. 2 is a flow diagram illustrating an exemplary method of managing vehicle priority in a self-organizing traffic control system from the perspective of a priority vehicle.
Figure 3:
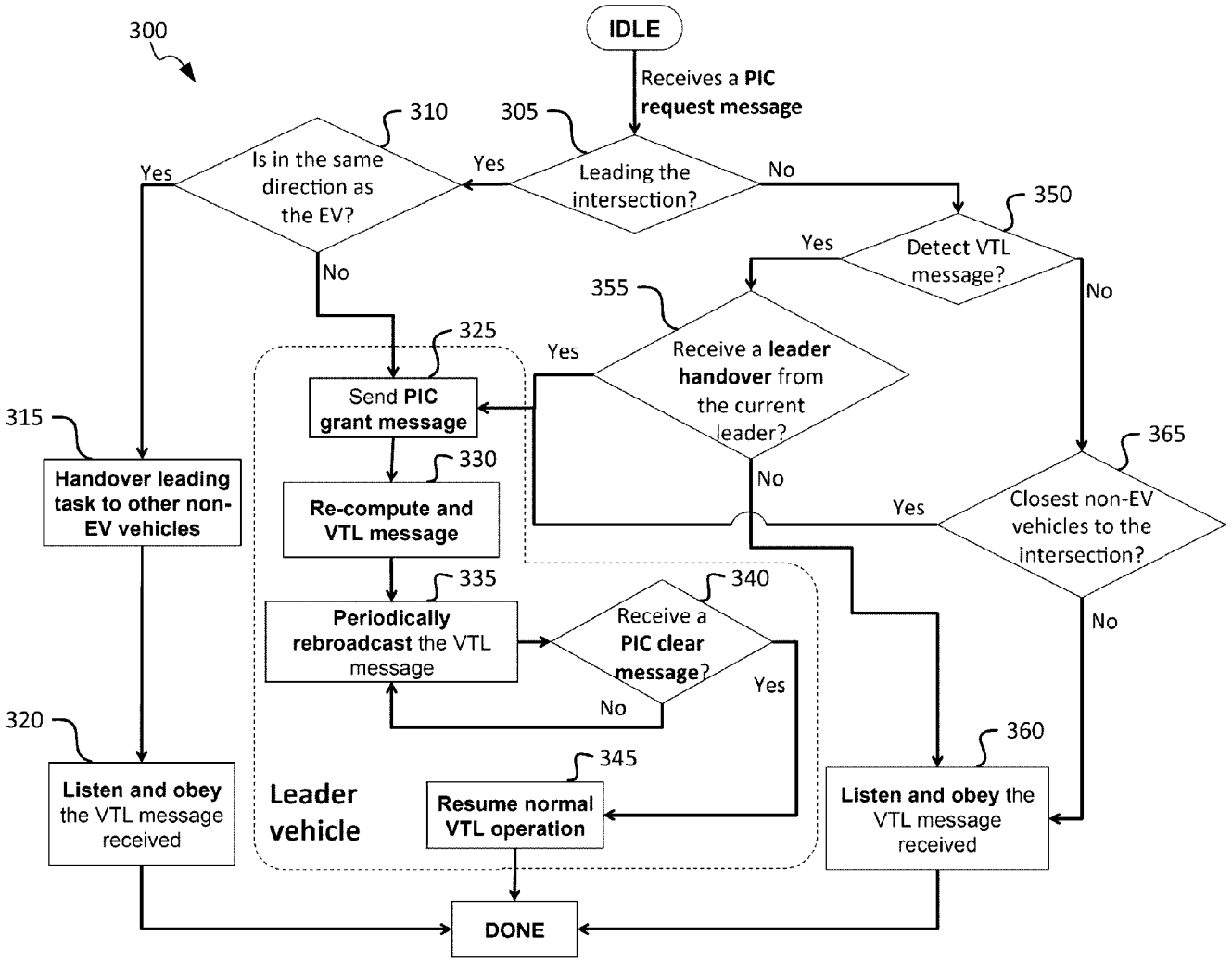
FIG. 3 is a flow diagram illustrating an exemplary method of managing vehicle priority in a self-organizing traffic control system from the perspective of a non-priority vehicle.

As presented above, vehicle priority in a self-organizing traffic control system can be regulated using, for example, method 100 of FIG. 1. As a particular example, FIGS. 2 and 3 illustrate methods 200 and 300, respectively, that can resolve potential travel-priority conflicts at a particular potential-travel-priority-conflict zone (e.g., an intersection) from the perspective of a priority vehicle and a non-priority vehicle, respectively. As will become apparent from reading on, the steps of methods 200 and 300 need not necessarily be performed in the order shown to achieve an equivalent result.

Referring now to FIG. 2, method 200 may begin at step 205, at which, upon approaching an intersection, a priority vehicle determines if there is already a DTCP or virtual traffic light ("VTL") set up for the intersection by passively listening to any VTL messages broadcasted by DTC systems of other vehicles proximate to the intersection. If no VTL exists and no conflict is detected at the intersection at step 210, method 200 may proceed to step 215, at which the DTC system of the priority vehicle may display a green light, indicating that the priority vehicle can pass through the intersection without any additional communication. However, if a DTC system on the priority vehicle detects that a VTL is already set up at step 205 or that a conflict exists at step 210, the priority vehicle may announce its presence with a priority-request message (also referred to herein as a priority intersection control ("PIC") message) and request priority for right-of-way at the intersection by sending a priority-request message at step 220 to one or more proximate vehicles, such as an elected traffic coordinator. In one specific example, the priority-request message sent at step 220 may be a PIC-request packet having the following composition: ||Packet Type|Unique Packet ID|Timestamp|Unique Vehicle Address|Coordinates|Direction|Lane ID||.

If a leader has not yet been elected, the closest vehicle to the intersection traveling in a direction orthogonal to or otherwise differing from that of the priority vehicle may automatically be chosen as the leader. A DTC system of the priority vehicle may periodically transmit the priority-request message until the priority vehicle receives a priority-granted (or PIC granted) message sent from an elected traffic coordinator at step 225 to acknowledge the presence of and grant priority to the priority vehicle, at which point the DTC system of the priority vehicle may display a green light, indicating that the priority vehicle can pass through the intersection. In one specific example, the priority-granted message received may be a PIC-granted packet having the following composition: ||Packet Type|Unique Packet ID|Timestamp|Unique Vehicle Address|Unique Vehicle Address of $1^{st}$ Granted Vehicles| . . . |Unique Vehicle Address of Last Granted Vehicles|Intersection ID||.

At step 230 of method 200, the DTC system of the priority vehicle may determine whether the priority vehicle is leaving or is close to leaving the intersection, the method returning to step 225 if not and proceeding to step 235 if so. At step 235, the DTC system of the priority vehicle may broadcast a priority-clear (or PIC clear) message to one or more proximal vehicles, such as an elected traffic coordinator, in order to release the intersection for normal traffic use. In one specific example, the priority-clear message received may be a PIC-clear packet having the following composition: ||Packet Type|Unique Packet ID|Timestamp|Unique Vehicle Address|Coordinates|Direction|Intersection ID||. As indicated in FIG. 2, in the unlikely case where the priority vehicle is approaching an intersection, the DTC system of the priority vehicle detects a VTL message at step 205 or a conflict at step 210, and no priority-granted message is received after transmitting one or more priority-request messages at step 220, method 200 may proceed from step 220 to step 240, at which the DTC system of the priority vehicle may instruct the priority vehicle driver to slow down and watch for other vehicles while crossing the intersection; the method may then proceed to step 235 and proceed as described above by sending a priority-clear message to any proximal vehicles. As indicated in FIG. 2, a DTC system of a priority vehicle may perform steps of method 200 whenever the priority vehicle reaches a new intersection or other potential-travel-priority-conflict zone and may otherwise remain in an idle or non-prioritized state.

Referring now to FIG. 3, method 300 may begin at step 305, at which, upon receipt of a priority-request (or PIC request) message and/or a beaconing signal from a DTC system of a priority vehicle, a DTC system in a non-priority vehicle may determine whether it is the current elected traffic coordinator (or leader) for an associated potential-travel-priority-conflict zone. If so, the DTC system of the non-priority vehicle then determines whether it should remain the traffic coordinator for the intersection at step 310. If the coordinator is traveling in the same direction as the priority vehicle, which, in this example, is an emergency vehicle (EV), and therefore potentially blocking its movement, the coordinator may hand off the traffic coordinator role to another non-priority vehicle at step 315, after which method 300 may proceed to step 320, wherein the former coordinator DTC system listens for and obeys any VTL messages or commands that may be issued by the new coordinator.

In some embodiments, such a determination of traveling direction of the priority vehicle may be determined by receiving route information for the priority vehicle and determining the travel direction of the priority vehicle as a function of the route information. In other embodiments, such a determination of traveling direction of the priority vehicle may be determined by receiving at least one beaconing signal from the priority vehicle and determining the travel direction of the priority vehicle as a function of said beaconing signal, which may comprise route information. Typically, at step 320, a non-priority vehicle will be given permission to pass through the intersection such that it will not block movement of the priority vehicle. However, if the coordinator is not traveling in the same direction as the priority vehicle, the current traffic coordinator should not block the movement of the priority vehicle and, as such, the coordinator continues its role as coordinator following step 310 and, at step 325, replies to the priority-request (or PIC request) message received from the priority vehicle with a priority-granted (or PIC granted) message. To permit the priority vehicle to pass through the intersection, the coordinator may re-compute the phase layout of the traffic signals at step 330 and periodically communicate the new configuration to one or more proximal vehicles at step 335. Once the coordinator detects or determines that the priority vehicle has left the intersection (either through the reception of a priority-clear (or PIC clear) message at step 340 and/or through a determination of a threshold of missing beaconing signals from the priority vehicle), method 300 may proceed to step 345, at which the coordinator may re-compute the traffic signal configuration to allow normal traffic management and/or periodically communicate the new configuration to one or more proximal vehicles.

If a DTC system in a non-priority vehicle receives a priority-request message and determines that it is not currently an elected traffic coordinator, method 300 may proceed from step 305 to step 350, at which the DTC system may determine whether any VTL message from another vehicle's DTC system can be or has been detected. If such a VTL message is detected, method 300 may proceed to step 355, at which the DTC system may determine whether a handover from a current coordinator can be or has been received. If so, method 300 may proceed to step 325 and proceed as described above; if not, method 300 may proceed to step 360, at which the DTC system may listen for and obey any VTL messages or commands that may be issued by the current traffic coordinator. On the other hand, if at step 350 no VTL message is detected, method 300 may proceed to step 365, at which the DTC system may determine whether the non-priority vehicle is the closest non-priority vehicle to the intersection. If so, method 300 may proceed to step 325 and proceed as described above; if not, method 300 may proceed to step 360 and proceed as described above. As indicated in FIG. 3, a DTC system of a non-priority vehicle may perform steps of method 300 whenever the non-priority vehicle receives a priority-request message and may otherwise remain in an idle or non-prioritizing state.

Figure 4A:
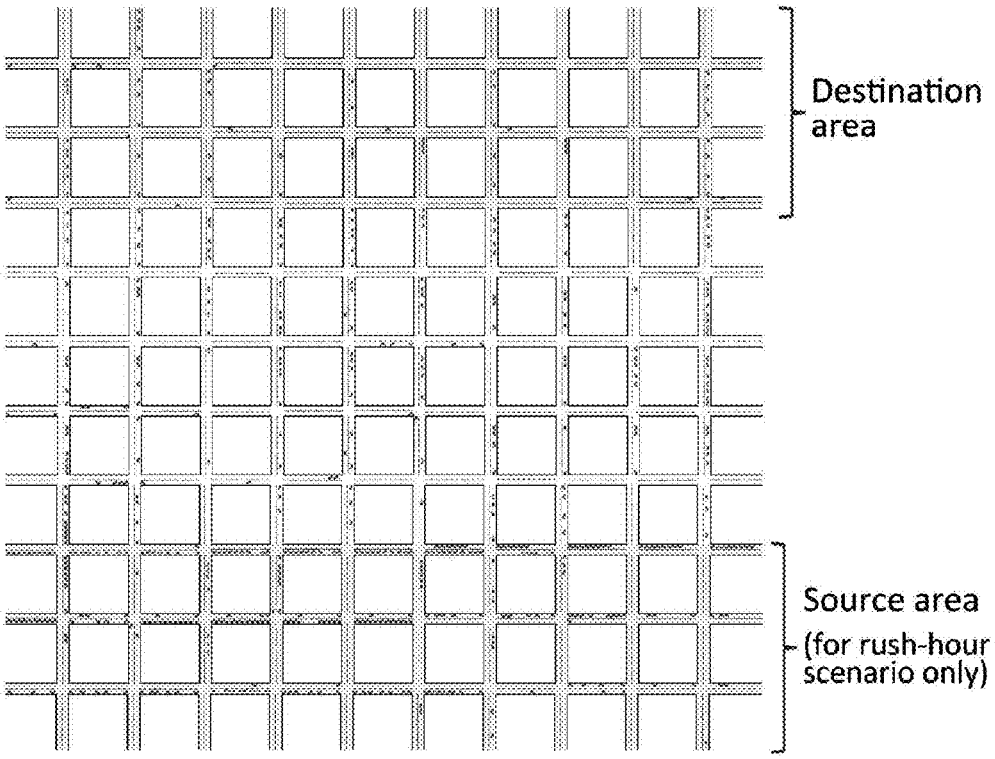
FIG. 4A is a top-down view of a road-grid topology used in simulations of methods of managing vehicle priority in a self-organizing traffic control system.
Figure 4B:
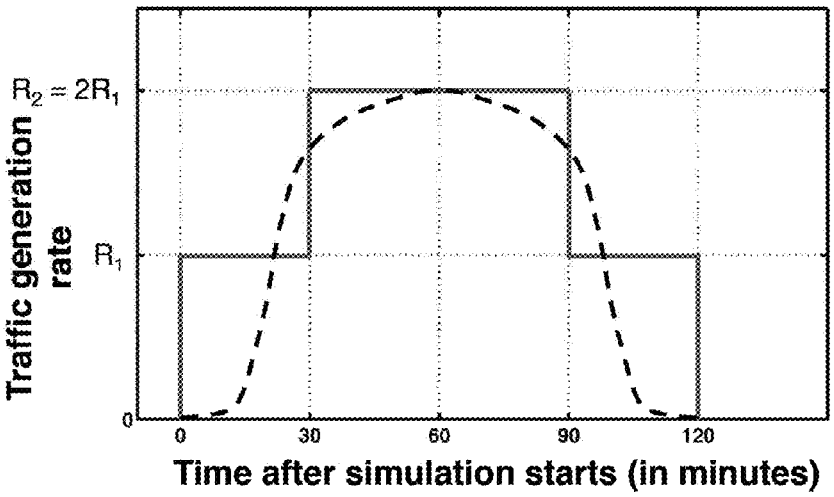
FIG. 4B is graph of a traffic generation pattern used in simulations involving the road-grid topology of FIG. 3A.

In order to evaluate some of the methods described above and to provide a concrete example, the present inventors employed the use of a traffic simulator. FIG. 4A represents a 10×10 Manhattan-style road-grid topology used in the simulations with 125-meter block length, wherein each dot in the grid represents an individual vehicle. The traffic generation pattern used in the simulations is depicted in FIG. 4B, wherein the traffic generation rate (e.g., $R_1$ and $R_2$, with units of vehicles per hour) varies based on one of the varying parameters, i.e., the number of total vehicles injected into the simulations, N. The step function shown in FIG. 4B is intended to represent traffic behavior during rush-hour periods; there is a first wave of commuters that try to enter/leave the city sooner (0 to 30 minutes into the simulation) to avoid traffic jams, which is followed by a period when most commuters enter/leave (30 to 90 minutes), and then the traffic generation rate tapers off as any remaining vehicles enter/leave (90 to 120 minutes). For reference, the dotted line in FIG. 4B illustrates a realistic traffic generation rate, the staircase shown and used in the simulations being an approximation thereof. For the purposes of the simulations conducted for this example scenario, the relationship between $R_1$, $R_2$, and N was determined according to the following equations.

$$R_1 = \frac{N}{3},$$

$$R_2 = 2R_1 = \frac{2N}{3}$$

In some simulations, one priority vehicle was inserted into the grid of FIG. 4A at t=5,400 seconds (i.e., 90 minutes after initializing the simulation). For the purposes of the simulation, all vehicles including the priority vehicle were assumed to be equipped with GPS (global positioning system) and a DSRC radio device with a transmission range of 200 meters. Also for the purposes of the simulation, in order to isolate the effect of network issues, it was assumed that there was no packet loss in the network, i.e., all sent transmissions are correctly received at the receiver(s).

Three different traffic control schemes were implemented and evaluated for two different scenarios (rush-hour and lunchtime): 1) a baseline scheme where only physical traffic lights are used at intersections and a priority vehicle does not receive any priority at intersections (referred to henceforth as a standard traffic light scheme or "TL"), 2) a VTL scheme where the virtual traffic light is used as the traffic control mechanism at intersections but does not give priority to the priority vehicle, and 3) a VTL scheme (also referred to herein as a virtual traffic light priority intersection control scheme or "VTL-PIC") where vehicle priority is managed such that priority vehicles are given priority as soon as possible at each intersection they approach.

Figure 5A:
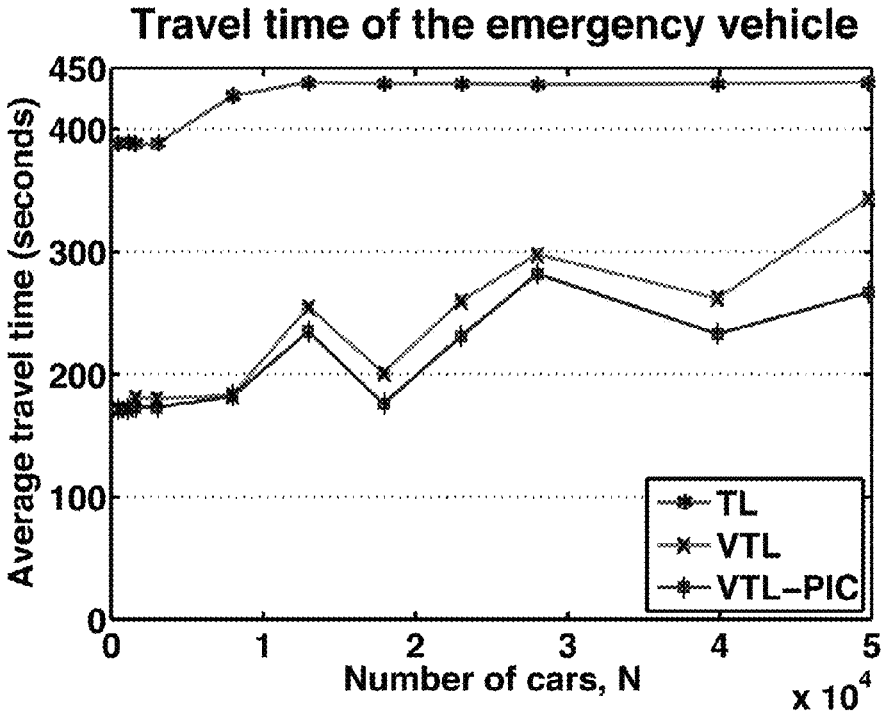
FIGS. 5A and 5B are graphs illustrating travel times for a priority vehicle and non-priority vehicles, respectively, in a rush-hour traffic simulation involving the road-grid topology of FIG. 4A.
Figure 5B:
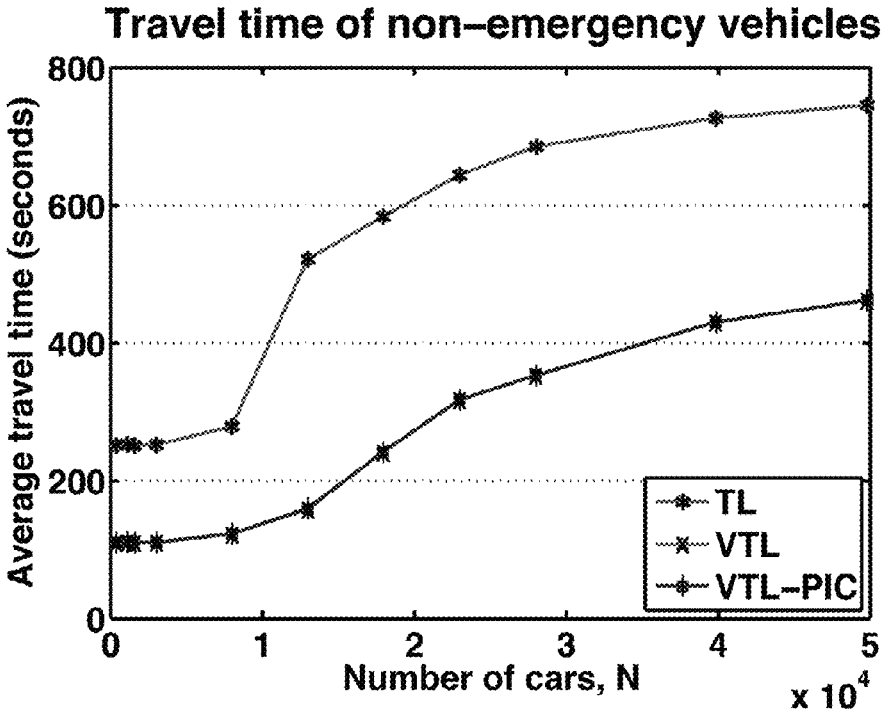

To simulate traffic patterns that occur during rush hours, vehicles in the simulator were assumed to start from their origination location in the 3×10 source area located at the bottom (or southern region) of the grid of FIG. 3A and proceed to the destination area corresponding to the 3×10 destination area at the top (or northern region). FIGS. 5A and 5B show the simulation results in terms of travel time of the priority- and non-priority vehicles, respectively, as a function of total number of vehicles generated, respectively. As shown, travel time of both types of vehicles decreases when a VTL system is in place, and the methods for managing priority described herein further decrease the travel time of the priority vehicle. Notably, as shown in FIG. 5B, whether methods for managing priority are used (VTL-PIC) or not (VTL), the travel times of non-priority vehicles remain essentially the same.

Figure 6A:
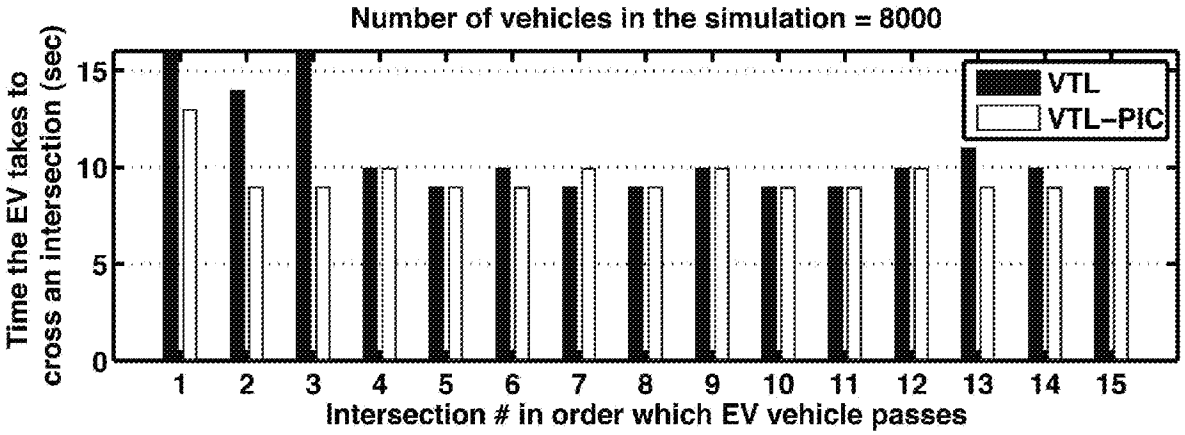
FIGS. 6A and 6B are charts illustrating average times priority vehicles take to cross intersections in simulations involving the road-grid topology of FIG. 4A using 8,000 and 40,000 vehicles, respectively.
Figure 6B:
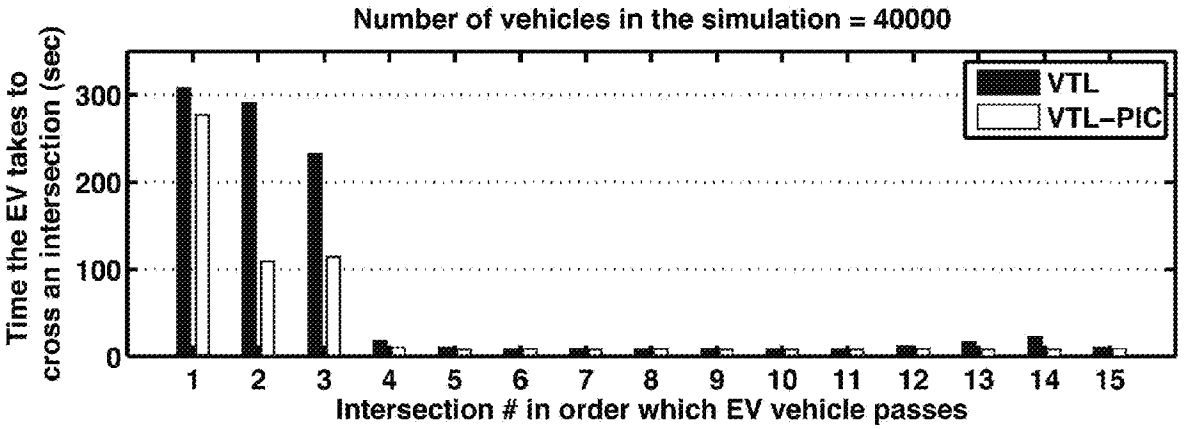

FIG. 6A presents in detail the time the priority vehicle takes to cross each intersection in a simulation using 8,000 vehicles. Note that, based on the pre-specified route from source area to destination area of FIG. 4A, the priority vehicle passes three intersections before it leaves the source area and up to 12 more intersections outside the source area before it reaches its destination. As a result, the priority vehicle typically encounters conflicts as it arrives at the first three intersections, but not necessarily afterwards. The reduction in the travel time of the priority vehicle is therefore gained primarily from the first three intersections. However, the time-saving advantages of the methods for managing priority described herein becomes more pronounced as the number of vehicles increases, as shown in FIG. 6B, which presents the time the priority vehicle takes to cross each intersection in a simulation using 40,000 vehicles. As illustrated in FIGS. 6A and 6B, the methods for managing priority described herein outperform non-prioritized VTL at the always-conflict intersections (i.e., intersections 1-3) and when there are larger numbers of vehicles in the simulations, thus leading to a higher level of conflicts at intersections. However, as described below, when the traffic pattern of non-priority vehicles is uniformly distributed (instead of the dominant "northbound" traffic of the rush-hour scenario), the benefits of the methods for managing priority described herein can be even more pronounced.

In contrast to the 3×10 source area used in obtaining the previous rush-hour results, in order to simulate traffic patterns during lunchtime, in a second example scenario, the entire 10×10 network was used as the source area. All non-priority vehicles were assigned random start and end locations. Similar to the rush-hour scenario, a priority vehicle was inserted at the center of the 3×10 area in the lower ("southern") part of the grid of FIG. 4A and proceeds to a destination at the top-right (or north-east) of the grid.

Figure 7A:
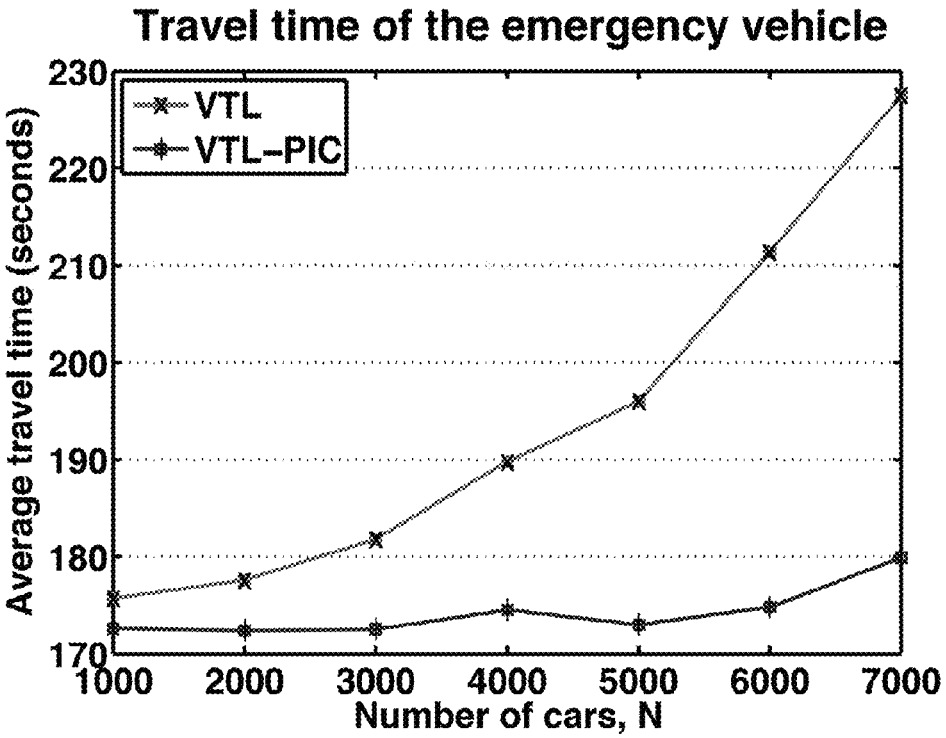
FIGS. 7A and 7B are graphs illustrating travel times for a priority vehicle and non-priority vehicles, respectively, in a lunchtime traffic simulation involving the road-grid topology of FIG. 3A.
Figure 7B:
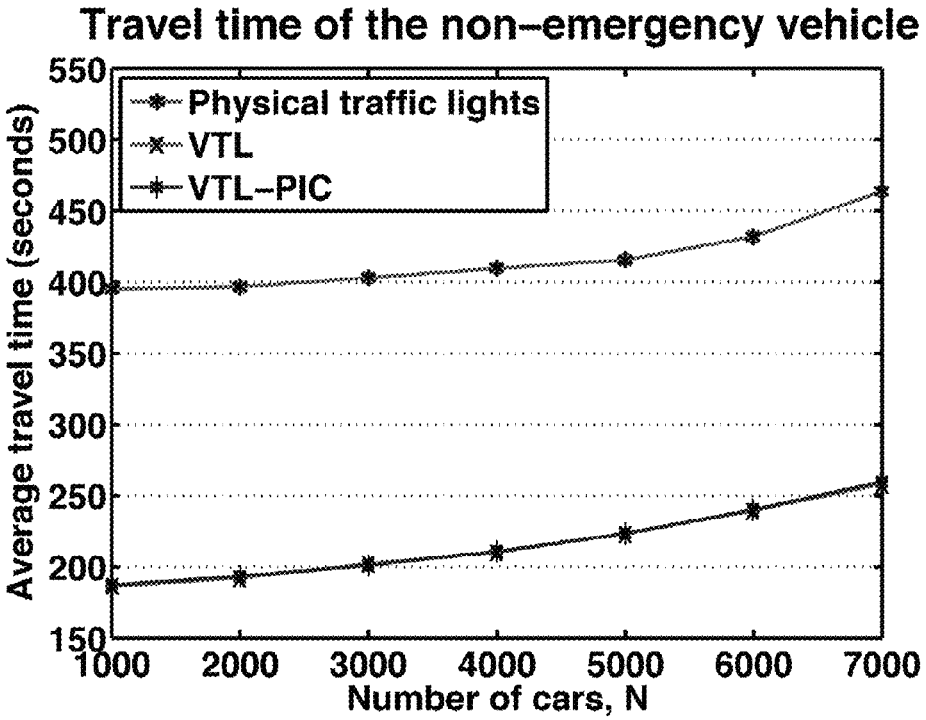

FIGS. 7A and 7B depict the average travel time of the priority and non-priority vehicles, respectively, for the lunchtime scenario. While the travel times of non-priority vehicles are similar both for non-prioritized VTL and for VTL employing one or more of the methods for managing priority described herein (i.e., VTL-PIC; see FIG. 7B), up to 45 seconds of travel time can be saved for the priority vehicle by utilizing ones of the methods for managing priority described herein. Notably, the benefits of the methods for managing priority described herein (VTL-PIC) over non-prioritized VTL become more pronounced as the total number of vehicles is increased in the lunchtime scenario. This larger benefit is due to the fact that the priority vehicle may experience no conflicts at all (as opposed to the three "always-conflict intersections" involved in the rush-hour scenarios) of the 16 intersections it crosses in this scenario. Note that the benefit in terms of travel time of a priority vehicle largely depends on the number of congested intersections; hence, the expected benefit will increase considerably when a larger urban area is assumed.

While the preceding examples primarily describe scenarios involving only direct vehicle-to-vehicle communication, other examples can also include communication from OBU's in vehicles to RSUs and then to other OBUs or communications with a central planner, thereby enabling avoidance of travel-priority conflicts over a geographic area and optimization of traffic flow. In some examples, this can be applied to Smart City applications.

In addition to the previously described examples, the present example is an extension of the above-described methods and can not only resolve priority conflicts on a conflict zone by conflict zone basis, but also optimize traffic flow over a geographic area containing many actual, anticipated, or potential travel priority conflicts. In this example, an intersection-based communication device/sensor can inform a DTC system by providing traffic-related information or by providing recommended route information, as supplied by a central coordinator. For example, either through communication methods described above (including beaconing and Geocasting, among others), or through information collected directly using techniques well known to those skilled in the art, an intersection-based communication device/sensor can gauge the degree of proximate congestion. An intersection-based communication device/sensor may be mounted on a building or on any convenient surface or structure, including on signposts, in below-street level structures, and so forth. This information can then be communicated using any communication method known to those skilled in the art, including both wired and wireless techniques, to a central coordinator.

A central coordinator, having been provided with analogous information from other travel-priority conflict zones over a geographic area containing a plurality of such zones, can provide one or more intersection-based communication devices/sensors with, for example, recommended directions for some or all of associated DTCPs, which may be determined as a function of one or more priority vehicles' travel-routes, positions, and/or other information received from and/or otherwise regarding one or more priority vehicles. These recommendations can then be communicated from the intersection-based communication device/sensor to one or more DTC systems using the techniques and methods previously described. Furthermore, a central coordinator can use information collected not only to provide information to a DTC system to inform its decision making process, such as by providing a known route for a priority vehicle received from an independent entity, such as a fire-house, police station, or municipal government, but the central coordinator can also dictate instructions to DTC systems, thereby centralizing coordination of traffic flow. Regardless of the degree of influence a central coordinator exercises over one or more DTC systems, methods described herein can be used in conjunction with such systems as SCADA (Supervisory Control and Data Acquisition), GERTRUDE (Gestion Electronique de Régulation du Trafic Urbain Défiant les Embouteillages), or other such centralized decision-making systems as used in Power Grid, Smart City, or Smart Grid systems.

In a specific embodiment of this example, a central coordinator (which can be a SCADA system or an Operating System of a central coordinator in a Smart City context) can communicate to one or more intersection-based communication devices/sensors the information that, for example, for northbound vehicles, the preferred travel option is to either continue traveling northbound or turn right within a provided number of blocks (or at a specific provided street), for example, in order to provide faster travel for one or more priority vehicles. This then centrally coordinates traffic flow based on information available to the central coordinator and not available to an individual vehicle.

It is to be noted that any one or more of the aspects and embodiments described herein may be conveniently implemented using one or more machines (e.g., one or more computing devices that are utilized as a user computing device for an electronic document, one or more server devices, such as a document server, etc.) programmed according to the teachings of the present specification, as will be apparent to those of ordinary skill in the computer art. Appropriate software coding can readily be prepared by skilled programmers based on the teachings of the present disclosure, as will be apparent to those of ordinary skill in the software art. Aspects and implementations discussed above employing software and/or software modules may also include appropriate hardware for assisting in the implementation of the machine executable instructions of the software and/or software module.

Such software may be a computer program product that employs a machine-readable storage medium. A machine-readable storage medium may be any medium that is capable of storing and/or encoding a sequence of instructions for execution by a machine (e.g., a computing device) and that causes the machine to perform any one of the methodologies and/or embodiments described herein. Examples of a machine-readable storage medium include, but are not limited to, a magnetic disk, an optical disc (e.g., CD, CD-R, DVD, DVD-R, etc.), a magneto-optical disk, a read-only memory "ROM" device, a random access memory "RAM" device, a magnetic card, an optical card, a solid-state memory device, an EPROM, an EEPROM, and any combinations thereof. A machine-readable medium, as used herein, is intended to include a single medium as well as a collection of physically separate media, such as, for example, a collection of compact discs or one or more hard disk drives in combination with a computer memory. As used herein, a machine-readable storage medium does not include transitory forms of signal transmission.

Such software may also include information (e.g., data) carried as a data signal on a data carrier, such as a carrier wave. For example, machine-executable information may be included as a data-carrying signal embodied in a data carrier in which the signal encodes a sequence of instructions, or portion thereof, for execution by a machine (e.g., a computing device) and any related information (e.g., data structures and data) that causes the machine to perform any one of the methodologies and/or embodiments described herein.

Examples of a computing device include, but are not limited to, an electronic book reading device, a computer workstation, a terminal computer, a server computer, a handheld device (e.g., a tablet computer, a smartphone, etc.), a web appliance, a network router, a network switch, a network bridge, any machine capable of executing a sequence of instructions that specify an action to be taken by that machine, and any combinations thereof. In one example, a computing device may include and/or be included in a kiosk.

Figure 8:
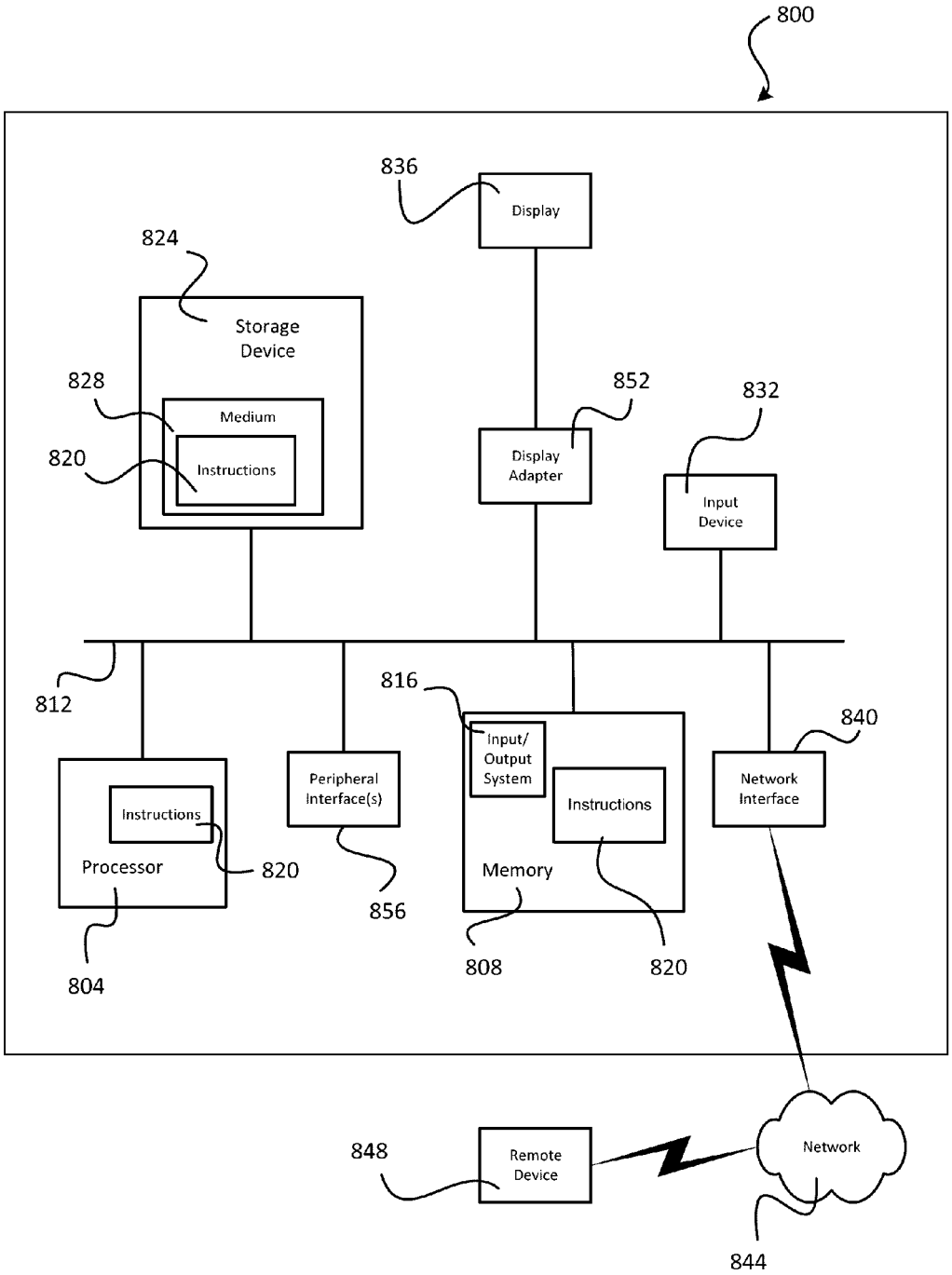
FIG. 8 is a block diagram of a computing system that can be used to implement any one or more of the methodologies disclosed herein and any one or more portions thereof.

FIG. 8 shows a diagrammatic representation of one embodiment of a computing device in the exemplary form of a computer system 800 within which a set of instructions for causing a control system, such as one or more components of a DTC system described herein, to perform any one or more of the aspects and/or methodologies of the present disclosure may be executed. It is also contemplated that multiple computing devices may be utilized to implement a specially configured set of instructions for causing one or more of the devices to perform any one or more of the aspects and/or methodologies of the present disclosure. Computer system 800 includes a processor 804 and a memory 808 that communicate with each other, and with other components, via a bus 812. Bus 812 may include any of several types of bus structures including, but not limited to, a memory bus, a memory controller, a peripheral bus, a local bus, and any combinations thereof, using any of a variety of bus architectures.

Memory 808 may include various components (e.g., machine readable media) including, but not limited to, a random access memory component, a read only component, and any combinations thereof. In one example, a basic input/output system 816 (BIOS), including basic routines that help to transfer information between elements within computer system 800, such as during start-up, may be stored in memory 808. Memory 808 may also include (e.g., stored on one or more machine-readable media) instructions (e.g., software) 820 embodying any one or more of the aspects and/or methodologies of the present disclosure. In another example, memory 808 may further include any number of program modules including, but not limited to, an operating system, one or more application programs, other program modules, program data, and any combinations thereof.

Computer system 800 may also include a storage device 824. Examples of a storage device (e.g., storage device 824) include, but are not limited to, a hard disk drive, a magnetic disk drive, an optical disc drive in combination with an optical medium, a solid-state memory device, and any combinations thereof. Storage device 824 may be connected to bus 812 by an appropriate interface (not shown). Example interfaces include, but are not limited to, SCSI, advanced technology attachment (ATA), serial ATA, universal serial bus (USB), IEEE 1394 (FIREWIRE), and any combinations thereof. In one example, storage device 824 (or one or more components thereof) may be removably interfaced with computer system 800 (e.g., via an external port connector (not shown)). Particularly, storage device 824 and an associated machine-readable medium 828 may provide nonvolatile and/or volatile storage of machine-readable instructions, data structures, program modules, and/or other data for computer system 800. In one example, software 820 may reside, completely or partially, within machine-readable medium 828. In another example, software 820 may reside, completely or partially, within processor 804.

Computer system 800 may also include an input device 832. In one example, a user of computer system 800 may enter commands and/or other information into computer system 800 via input device 832. Examples of an input device 832 include, but are not limited to, an alpha-numeric input device (e.g., a keyboard), a pointing device, a joystick, a gamepad, an audio input device (e.g., a microphone, a voice response system, etc.), a cursor control device (e.g., a mouse), a touchpad, an optical scanner, a video capture device (e.g., a still camera, a video camera), a touchscreen, and any combinations thereof. Input device 832 may be interfaced to bus 812 via any of a variety of interfaces (not shown) including, but not limited to, a serial interface, a parallel interface, a game port, a USB interface, a FIREWIRE interface, a direct interface to bus 812, and any combinations thereof. Input device 832 may include a touch screen interface that may be a part of or separate from display 836, discussed further below. Input device 832 may be utilized as a user selection device for selecting one or more graphical representations in a graphical interface as described above.

A user may also input commands and/or other information to computer system 800 via storage device 824 (e.g., a removable disk drive, a flash drive, etc.) and/or network interface device 840. A network interface device, such as network interface device 840, may be utilized for connecting computer system 800 to one or more of a variety of networks, such as network 844, and one or more remote devices 848 connected thereto. Examples of a network interface device include, but are not limited to, a network interface card (e.g., a mobile network interface card, a LAN card), a modem, and any combination thereof. Examples of a network include, but are not limited to, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network, such as network 844, may employ a wired and/or a wireless mode of communication. In general, any network topology may be used. Information (e.g., data, software 820, etc.) may be communicated to and/or from computer system 800 via network interface device 840.

Computer system 800 may further include a video display adapter 852 for communicating a displayable image to a display device, such as display device 836. Examples of a display device include, but are not limited to, a liquid crystal display (LCD), a cathode ray tube (CRT), a plasma display, a light emitting diode (LED) display, and any combinations thereof. Display adapter 852 and display device 836 may be utilized in combination with processor 804 to provide graphical representations of aspects of the present disclosure. In addition to a display device, computer system 800 may include one or more other peripheral output devices including, but not limited to, an audio speaker, a printer, and any combinations thereof. Such peripheral output devices may be connected to bus 812 via a peripheral interface 856. Examples of a peripheral interface include, but are not limited to, a serial port, a USB connection, a FIREWIRE connection, a parallel connection, and any combinations thereof.

In some embodiments, the present disclosure is directed to a method of managing vehicle priority proximate to a potential travel-priority conflict zone, the method being executed in a dynamic traffic control system and comprising: communicating with a first component of the dynamic traffic control system located on-board a vehicle proximate to the potential travel-priority conflict zone so as to establish a dynamic traffic control plan for avoiding a travel-priority conflict in the potential travel-priority conflict zone; coordinating with the first component of the dynamic traffic control system via said communicating to elect a dynamic traffic controller as a temporary coordinator vehicle responsible for temporarily coordinating the dynamic traffic control plan; receiving a priority-request message from a priority vehicle; and transmitting a priority-granted message to the priority vehicle. Such a method may further comprise retrieving a priority level from the priority-request message and modifying the dynamic traffic control plan as a function of the priority level. The priority level may be one of at least three levels and said modifying the dynamic traffic control plan as a function of the priority level may include selecting from among at least two modification schemes. Further, said selecting from among at least two modification schemes may include selecting from among an emergency-vehicle modification scheme and a mass-transit-vehicle modification scheme. In the context of such a method, said receiving a priority-request message may include receiving a priority-request message from a mass-transit vehicle. The method may further comprise modifying the dynamic traffic control plan by weighting the mass-transit vehicle higher than at least some non-mass-transit vehicles. In some embodiments, at least a portion of said communicating is performed via roadside units. In such a method, determining a travel direction may further comprise: receiving route information for the priority vehicle and determining the travel direction of the priority vehicle as a function of said route information. A beaconing signal may also comprise route information and/or a priority vehicle indicator.

In other embodiments, the present disclosure is directed to a method of managing vehicle priority proximate to a potential travel-priority conflict zone, the method being executed in a dynamic traffic control system and comprising: communicating with a first component of the dynamic traffic control system located on-board a vehicle proximate to the potential travel-priority conflict zone so as to establish a dynamic traffic control plan for avoiding a travel-priority conflict in the potential travel-priority conflict zone; coordinating with the first component of the dynamic traffic control system via said communicating to elect a dynamic traffic controller as a temporary coordinator vehicle responsible for temporarily coordinating the dynamic traffic control plan; receiving a priority-request message from a priority vehicle; retrieving a priority level from the priority-request message; and modifying the dynamic traffic control plan as a function of the priority level. In the context of such a method, the priority level may be one of at least three levels and said modifying the dynamic traffic control plan as a function of the priority level includes selecting from among at least two modification schemes. Further, said selecting from among at least two modification schemes may include selecting from among an emergency-vehicle modification scheme and a mass-transit-vehicle modification scheme. In some embodiments, said receiving a priority-request message may include receiving a priority-request message from an emergency vehicle or a mass-transit vehicle. Such a method may further comprise modifying the dynamic traffic control plan by weighting the mass-transit vehicle higher than at least some non-mass-transit vehicles. Such a method may additionally or alternatively further comprise: determining a travel direction of the priority vehicle; analyzing the travel direction of the priority vehicle relative to a travel direction of one or more non-priority vehicles proximate to the potential travel-priority conflict zone; and determining whether to transmit the priority-granted message to the priority vehicle as a function of said analyzing. Said determining a travel direction may further comprise: receiving route information for the priority vehicle; and determining the travel direction of the priority vehicle as a function of said route information. Said determining a travel direction may further comprise: receiving at least one beaconing signal from the priority vehicle; and determining the travel direction of the priority vehicle as a function of said beaconing signal. Said at least one beaconing signal may comprise route information and/or a priority vehicle indicator.

Notably, machine-executable instructions for performing any one or more of the methods disclosed herein may be stored in a machine-readable storage medium.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve methods, systems, and software according to the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A method of managing vehicle priority proximate to a potential travel-priority conflict zone, the method being executed in a dynamic traffic control system and comprising:

communicating with a first component of the dynamic traffic control system located on-board a vehicle proximate to the potential travel-priority conflict zone so as to establish a dynamic traffic control plan for avoiding a travel-priority conflict in the potential travel-priority conflict zone;

coordinating with the first component of the dynamic traffic control system via said communicating to elect a dynamic traffic controller as a temporary coordinator vehicle responsible for temporarily coordinating the dynamic traffic control plan;

receiving a priority-request message from a priority vehicle;

determining a travel direction of the priority vehicle;

comparing the travel direction of the priority vehicle to a travel direction of a non-priority vehicle proximate to the potential travel-priority conflict zone;

transmitting a priority-granted message to the priority vehicle when the travel direction of the priority vehicle and the travel direction of the non-priority vehicle proximate to the potential travel-priority conflict zone differ; and providing traffic control instructions to an operator of the priority vehicle via a visual or audio indication produced in the priority vehicle as a function of the priority-granted message.

2. A method of managing vehicle priority proximate to a potential travel-priority conflict zone, the method being executed in a dynamic traffic control system and comprising:

communicating with a first component of the dynamic traffic control system located on-board a vehicle proximate to the potential travel-priority conflict zone so as to establish a dynamic traffic control plan for avoiding a travel-priority conflict in the potential travel-priority conflict zone;

coordinating with the first component of the dynamic traffic control system via said communicating to elect a first dynamic traffic controller as a first temporary coordinator vehicle responsible for temporarily coordinating the dynamic traffic control plan;

receiving a priority-request message from a priority vehicle;

determining a travel direction of the priority vehicle;

comparing the travel direction of the priority vehicle to a travel direction of a non-priority vehicle proximate to the potential travel-priority conflict zone; and when the travel direction of the priority vehicle and the travel direction of the non-priority vehicle proximate to the potential travel-priority conflict zone are the same, coordinating with the first component of the dynamic traffic control system via said communicating to hand over responsibility for coordinating the dynamic traffic control plan to a new temporary coordinator vehicle by electing a second dynamic traffic controller as a second temporary coordinator vehicle responsible for temporarily coordinating the dynamic traffic control plan.

3. A method according to claim 1 or 2, wherein said receiving a priority-request message includes receiving a priority-request message from an emergency vehicle.

4. A method according to claim 1 or 2, further comprising receiving a priority-clear message from the priority vehicle.

5. A method according to claim 1 or 2, wherein at least a portion of said communicating is performed via vehicle-to-vehicle communication.

6. A method according to claim 1 or 2, further comprising revoking priority for the priority vehicle if no transmissions are received from the priority vehicle for a predetermined period of time.

* * * * *